US007661579B2

(12) United States Patent
Kruelle et al.

(10) Patent No.: US 7,661,579 B2
(45) Date of Patent: Feb. 16, 2010

(54) PACKAGING CONTAINER, AND METHOD AND APPARATUS FOR MAKING SAME

(75) Inventors: John M. Kruelle, Glendale, AZ (US); Thomas A. Ketzer, Cincinnati, OH (US); Joseph Manes, Phoenix, AZ (US); Frank Valenzano, West Monroe, LA (US)

(73) Assignee: Illinois Tool Works Inc., Glenview, IL (US)

( * ) Notice: Subject to any disclaimer, the term of this patent is extended or adjusted under 35 U.S.C. 154(b) by 488 days.

(21) Appl. No.: 11/228,408

(22) Filed: Sep. 19, 2005

(65) Prior Publication Data

US 2007/0063006 A1 Mar. 22, 2007

(51) Int. Cl.
*B65D 3/22* (2006.01)

(52) U.S. Cl. ..... 229/122.34; 229/930; 229/939

(58) Field of Classification Search ..... 229/122.34, 229/930, 125.03, 125.01, 185.1, 906, 939
See application file for complete search history.

(56) References Cited

U.S. PATENT DOCUMENTS 1,022,923 A * 4/1912 Bird ..... 493/89
1,758,230 A * 5/1930 Lange ..... 428/154
3,122,300 A * 2/1964 La Bombard ..... 229/100
4,976,374 A 12/1990 Macaluso
5,048,689 A * 9/1991 McFarland ..... 206/586
5,947,290 A 9/1999 Loeschen
6,773,790 B2 * 8/2004 Lasson ..... 428/156
6,794,018 B2 9/2004 Clark
6,851,602 B2 2/2005 Gosis et al.
2004/0185992 A1 9/2004 Tisdale

* cited by examiner

*Primary Examiner*—Nathan J Newhouse
*Assistant Examiner*—Christopher Demeree
(74) *Attorney, Agent, or Firm*—Law Offices of Steven W. Weinrieb

(57) ABSTRACT

A new and improved packaging container, and a method and apparatus for fabricating the same, comprises a laminated structure comprising a plurality of plies formed from suitable paper or similar materials. The plurality of plies, having a predetermined width dimension, are bonded together in a substantially flattened state by glue which is applied in predetermined, axially extending, laterally staggered patterns. Subsequently, the substantially flat, laminated structure is longitudinally scored or embossed at predetermined lateral or transverse positions so as to effectively predispose, and thereby facilitate, for example, the upward folding of oppositely disposed side members of the laminated structure with respect to a central member of the laminated structure whereby the resulting packaging container not only has a desirable substantially U-shaped cross-sectional configuration, but in addition, has optimized flexural beam strength characteristics within its corner regions due to the fact that the oppositely disposed corner regions preferably comprise the same number of multiple plies as the side wall and bottom wall members of the packaging container.

16 Claims, 5 Drawing Sheets

FIG. 1
(PRIOR ART)
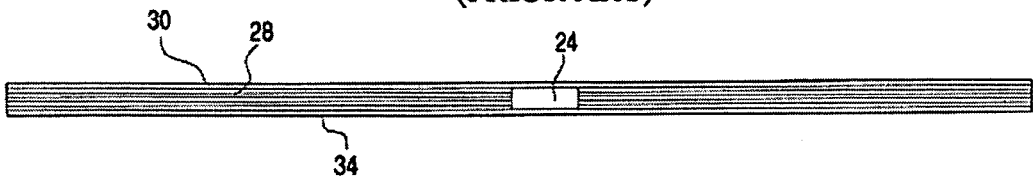
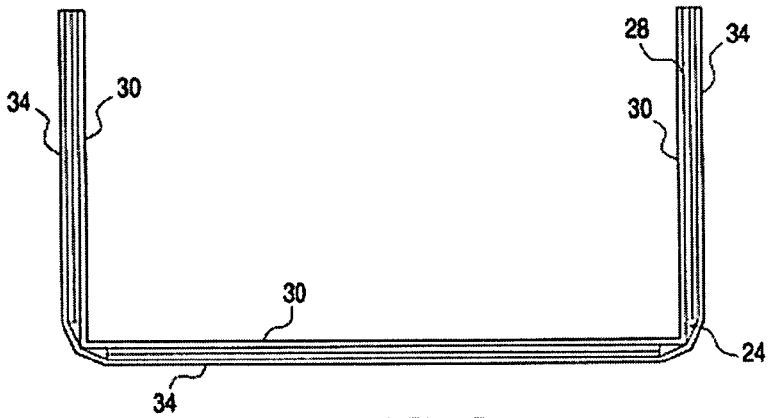
FIG. 2
(PRIOR ART)
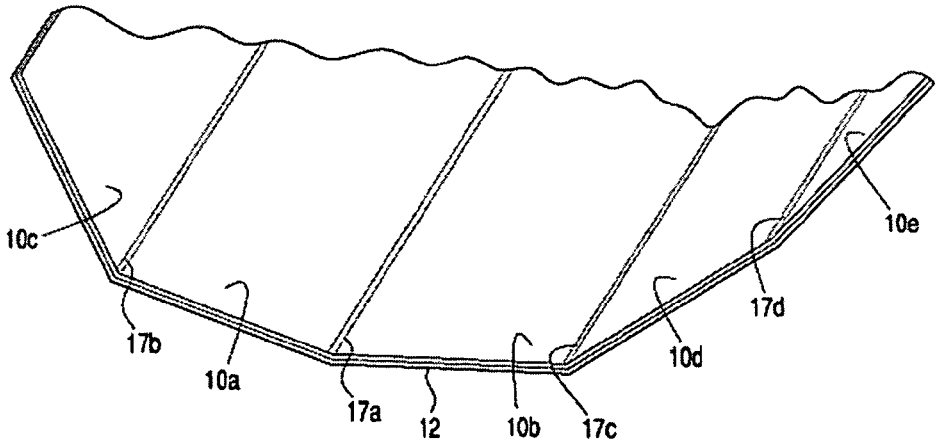
FIG. 3
(PRIOR ART)

PACKAGING CONTAINER, AND METHOD AND APPARATUS FOR MAKING SAME

FIELD OF THE INVENTION

The present invention relates generally to packaging containers, and more particularly to a new and improved packaging container, and a method and apparatus for making the same, wherein the packaging container comprises a laminated structure comprising a plurality of plies formed from suitable paper, cardboard, corrugated board, thermoplastic materials, or the like, and wherein further, the plurality of plies, having a predetermined width dimension, are bonded together in a substantially flattened state by means of a suitable adhesive or glue which is applied in predetermined, longitudinally or axially extending patterns, and subsequently, the substantially flat, laminated structure is also longitudinally or axially scored or embossed at predetermined lateral or transverse positions so as to effectively facilitate or simplify, for example, the upward folding of oppositely disposed side wall members of the laminated structure with respect to a central bottom wall member of the laminated structure whereby the resulting packaging container not only has a desirable substantially U-shaped cross-sectional configuration, but in addition, has optimized flexural beam strength characteristics within the corner regions thereof due to the fact that the oppositely disposed corner regions comprise the same number of multiple plies as the side wall and bottom wall members of the packaging container.

BACKGROUND OF THE INVENTION

Packaging containers, for use in connection with the housing, storing, shipping, and transportation of lengthy or elongated articles, such as, for example, glass or steel rods, pipes, lumber, vertical blinds, or the like, are often formed as structures having a substantially U-shaped cross-sectional configuration. Representative packaging containers of the aforenoted type are disclosed, for example, within U.S. Pat. No. 6,851,602 which issued to Gosis et al. on Feb. 8, 2005, U.S. Pat. No. 6,794,018 which issued to Clark on Sep. 21, 2004, U.S. Pat. No. 5,947,290 which issued to Loeschen on Sep. 7, 1999, U.S. Pat. No. 4,976,374 which issued to Macaluso on Dec. 11, 1990, and United States Patent Application Publication 2004/0185992 which was published in the name of Tisdale on Sep. 23, 2004. As can be readily appreciated from such prior art, a first type of packaging container comprises those packaging containers which are actually formed as a substantially rigid structure having the substantially U-shaped cross-sectional configuration, as exemplified by means of the structures disclosed within the aforenoted patents which issued to Gosis et al. and Macaluso, however, it is noted that due to the particular configuration of the packaging container, as well as the rigidity of the same, the a plurality of the packaging containers cannot effectively be disposed in a nested manner with respect to each other. Accordingly, when the packaging containers are being shipped from their site of manufacture to, for example, distributors or end users, or when the packaging containers are being stored within warehouse facilities of such distributors or end users, the packaging containers require a substantially large amount of space which is both wasteful and costly.

Ideally, then, a second type of packaging container of the aforenoted type is one in which the packaging container is initially fabricated as a substantially flat structure, and subsequently, oppositely disposed, laterally or transversely separated side portions of the substantially flat structure are subsequently folded upwardly, for example, so as to form the upwardly extending side wall members of the packaging container and which will cooperate with an intermediate portion of the substantially flat structure so as to thereby form the finalized U-shaped packaging container. This type of packaging container is exemplified by means of the packaging container structure disclosed within the aforenoted patent that issued to Clark, as well as the packaging container structure disclosed within the aforenoted patent publication that was published in the name of Tisdale. A common problem that usually develops, however, in connection with the fabrication of such a finalized U-shaped packaging container from the originally fabricated substantially flat structure, resides in the difficulty encountered in connection with the upward folding of the oppositely disposed, laterally or transversely separated side portions of the substantially flat structure so as to in fact form the upwardly extending side wall members of the packaging container. Accordingly, as can therefore be appreciated still further from the disclosures of the aforenoted patent to Clark, as well as from the aforenoted patent publication of Tisdale, the originally fabricated, substantially flat structures have means incorporated therewithin for facilitating the upward folding of the side wall members of the packaging containers such that the packaging containers can in fact achieve their substantially U-shaped cross-sectional configurations.

More particularly, as disclosed within FIGS. 1 and 2, which substantially correspond to FIGS. 2 and 3 of the aforenoted patent which issued to Clark, a packaging container is initially disclosed as being in its flattened state within FIG. 1. It is further seen that the structure of the flattened packaging container comprises a plurality of support members 28 having first and second sealing layers 30,34 respectively disposed upon the upper and lower surface portions thereof, and that in order to facilitate the upward folding of laterally or transversely spaced, oppositely disposed side wall members of the packaging container with respect to a central bottom wall member of the packaging container, a plurality of collapsible channels 24 are defined at predetermined locations within the flattened packaging container structure at which the laterally or transversely spaced, oppositely disposed side wall members of the packaging container are desired to be folded upwardly with respect to the central bottom wall member of the packaging container. In this manner, when each one of the laterally or transversely spaced, oppositely disposed side wall members of the packaging container is desired to be folded upwardly with respect to the central bottom wall member of the packaging container, a respective one of the collapsible channels 24 will in fact facilitate such upward folding of the particular one of the laterally or transversely spaced, oppositely disposed side wall members of the packaging container with respect to the central bottom wall member of the packaging container. It is noted, however, that in view of the incorporation or formation of the collapsible channels 24 within those regions of the flattened packaging container structure which will effectively become the corner regions of the subsequently formed U-shaped packaging container, the corner regions of the U-shaped packaging container are only effectively defined by means of the first and second sealing layers 30,34 which are respectively disposed upon the upper and lower surface portions of the packaging container structure. Accordingly, in view of the minimal number of plies 30,34 which therefore effectively comprise the corner regions of the packaging container, such corner regions of the packaging container will not exhibit substantial flexural beam strength which, of course, can be detrimental to the protective properties characteristic of the packaging container with respect to the articles contained therein.

Continuing further, and with reference now being made to FIG. 3, which substantially corresponds to FIG. 4A of the aforenoted patent publication to Tisdale, the packaging container is seen to comprise an upper or internal sheet member 10, and a lower or external sheet member 12, wherein each one of the upper or internal, and lower or external, sheet members 10,12 may comprise a multi-ply laminate or panel. The upper or internal sheet member 10 is adapted to be bonded to the upper or internal surface portion of the lower or external sheet member 12, however, prior to the bonding of the upper or internal sheet member 10 to the lower or external sheet member 12, the upper or internal sheet member 10 is severed into a plurality of sections 10*a*-10*e* as a result of the upper or internal sheet member 10 being slit along lines 17*a*-17*d*. In addition, when the various sections 10*a*-10*e* of the upper or internal sheet member 10 are bonded to the lower or external sheet member 12, the sections 10*a*-10*e* of the upper or internal sheet member 10 are spaced a predetermined distance apart from each other. In this manner, the spaces 17*a*-17*d* defined between the adjacent sections 10*a*-10*e* of the upper or internal sheet member 10 will facilitate the upward folding of the composite packaging container structure comprising the sections 10*a*-10*e* of the upper or internal sheet member 10 and the underlying lower or external sheet member 12.

It is to be appreciated, however, that this packaging container structure is somewhat similar to the packaging container structure which has been disclosed within the patent issued to Clark, as has been previously discussed, in that the corner structures of the packaging container of Tisdale will only be defined by means of the plies of the lower or external sheet member 12 and not, for example, by means of all of the plies comprising both the upper or internal sheet member 10 and the underlying lower or external sheet member 12 comprising the entire packaging container structure. Accordingly, still further, as was the case with the packaging structure of Clark, such corner regions of the packaging container will not exhibit substantial flexural beam strength which, again, can be detrimental to the protective properties characteristic of the packaging container with respect to the articles contained therein.

A need therefore exists in the art for a new and improved multi-ply packaging container, having a substantially U-shaped cross-sectional configuration comprising, for example, a bottom wall member and a pair of oppositely disposed upstanding side wall members integrally connected to the bottom wall member, wherein means could be incorporated within the corner regions of the packaging container, as defined between the bottom wall member and each one of the pair of oppositely disposed upstanding side wall members, so as to enable the packaging container to be initially fabricated in a flattened state, and yet facilitate the subsequent upward folding of the side wall members with respect to the bottom wall member, and wherein further, the number of plies comprising the packaging container is substantially the same throughout the bottom wall member, the pair of oppositely disposed upstanding side wall members, and within the corner regions of the packaging container, as defined between the bottom wall member and each one of the pair of oppositely disposed upstanding side wall members, so as to preserve the structural integrity and flexural beam strength properties of the packaging container.

SUMMARY OF THE INVENTION

The foregoing and other objectives are achieved in accordance with the teachings and principles of the present invention through the provision of a new and improved packaging container, and a method and apparatus for fabricating the same, which comprises a laminated structure comprising a plurality of plies formed from suitable paper, cardboard, corrugated board, thermoplastic materials, or the like, and wherein further, the plurality of plies, having a predetermined width dimension, are bonded together in a substantially flattened state by means of a suitable adhesive or glue which is applied in predetermined, longitudinally or axially extending patterns. Subsequently, the substantially flat, laminated structure is longitudinally or axially scored or embossed at predetermined lateral or transverse positions so as to effectively predispose, and thereby facilitate or simplify, for example, the upward folding of oppositely disposed side wall members of the laminated structure with respect to a central bottom wall member of the laminated structure whereby the resulting packaging container not only has a desirable substantially U-shaped cross-sectional configuration, but in addition, has optimized flexural beam strength characteristics within the corner regions thereof due to the fact that the oppositely disposed corner regions comprise the same number of multiple plies as the side wall and bottom wall members of the packaging container.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 1 is a side elevational view of a conventional, PRIOR ART packaging structure disposed in its flattened state and showing the incorporation therewithin of the collapsible channels;

FIG. 2 is a side elevational view of the conventional, PRIOR ART packaging structure, as illustrated within FIG. 1, after the side wall members thereof have been folded upwardly with respect to the bottom wall member, as facilitated by means of the collapsible channels incorporated within the corner regions of the packaging structure, so as to achieve a packaging container having a substantially U-shaped cross-sectional configuration;

FIG. 3 is a perspective view of another conventional, PRIOR ART packaging structure wherein the side wall members thereof are disclosed as being partially folded in an upward manner, as facilitated by means of the transversely spaced upper sheet members bonded to the upper surface portions of the lower sheet member, so as to begin the formation of the packaging container;

DETAILED DESCRIPTION OF THE PREFERRED EMBODIMENT

Figure 4:
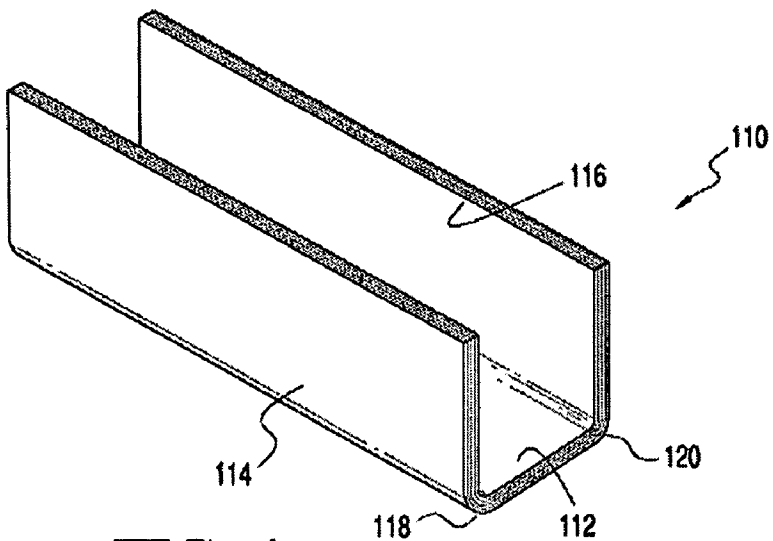
FIG. 4 is a perspective view of a new and improved packaging container constructed in accordance with the principles and teachings of the present invention such that the packaging container has a substantially U-shaped cross-sectional configuration.

Referring now to the drawings, and more particularly to FIG. 4 thereof, a new and improved packaging container, constructed in accordance with the principles and teachings of the present invention, is disclosed and is generally indicated by the reference character 110. As can readily be appreciated, the new and improved packaging container 110 is fabricated from a plurality of plies of material, such as, for example, paper, cardboard, corrugated cardboard, plastic, and the like, and has a substantially U-shaped cross-sectional configuration. More particularly, the U-shaped packaging container 110 is seen to comprise a horizontally disposed bottom wall member 112, and a pair of oppositely disposed, laterally or transversely spaced vertically upstanding side wall members 114,116 which extend substantially perpendicular to the horizontally disposed bottom wall member 112. In addition, it is to be appreciated that the packaging container 110 is fabricated from a packaging structure which is initially manufactured in a flattened state, and subsequently, a pair of oppositely disposed, laterally or transversely spaced side portions of the packaging structure are folded upwardly, at predetermined laterally or transversely spaced locations, with respect to a central portion of the packaging structure such that the side wall members 114,116 extend vertically upwardly with respect to the horizontally disposed bottom wall member 112 at oppositely disposed corner regions 118, 120 of the packaging container 110.

As can best be appreciated from FIGS. 5 and 10, the packaging structure 122, from which the packaging container 110 is fabricated, is initially manufactured in its flattened state as a result of a plurality of plies or sheets 124,126,128,130 of material, such as, for example, paper, cardboard, corrugated cardboard, thermoplastics, or the like, being respectively withdrawn from a plurality of material supply rolls or reels 132,134,136,138, and subsequently being combined together into a composite or laminate structure. The supply rolls or reels 132,134,136,138 are respectively mounted within suitable frameworks 140,142,144,146, and the frameworks 140, 142,144,146 are respectively provided with a plurality of vertically upstanding material guides 148,150,152, 154 through which, for example, the individual material plies or sheets 126,128,130 are routed so as to initially maintain the individual material plies 126,128,130 in a parallel state with respect to each other. After passing through the vertically upstanding material guide 148, the individual material plies or sheets 126,128,130, respectively withdrawn from the supply rolls or supply reels 134,136,138, are conducted, along with the material ply or sheet 124 which is withdrawn from the supply roll or supply reel 132, toward a glue application tree structure 156. The glue application tree structure 156 is seen to comprise a framework 158 upon which there is disposed a glue applicator tree 160 within which, or operatively associated with which, there is provided a plurality of glue application nozzles, not illustrated, from which a suitable glue composition is adapted to be discharged or extruded in accordance with predetermined glue-application patterns as will become more fully appreciated shortly hereinafter. A vertically upstanding material guide mechanism 162 is also provided upon the glue applicator tree structure framework 158 so as to serve as a means for maintaining the incoming material plies or sheets 124,126,128,130 in a vertically spaced arrangement or array in order to facilitate the deposition or extrusion of the glue composition onto one or more of the individual material plies or sheets 124,126,128, 130. A vertically disposed array of photodetectors or similar sensors 163 is disposed upstream of the glue applicator tree 160 so as to detect the presence of the individual plies or sheets 124, 126,128,130 as being intact and continuous.

Subsequently, after passing through the glue applicator tree 160 wherein the glue composition has been applied to one or more of the material plies or sheets 124,126,128, 130 in accordance with predetermined glue-application patterns, the plurality of material plies or sheets 124,126,128, 130 are conducted through a nip defined between a pair of vertically stacked presser rollers 164, and after being pressed together by means of the pair of vertically stacked presser rollers 164 so as to form a composite or laminate sheet structure, the composite or laminate sheet structure is conducted through a pair of vertically stacked embossing or scoring rollers 166 whereby the composite or laminate sheet structure is scored or embossed at predetermined, laterally or transversely spaced locations 168,170 as clearly illustrated within FIG. 5. Lastly, the scored or embossed composite or laminate sheet structure is conducted through a suitable cutting mechanism 172 whereby the scored or embossed composite or laminate sheet structure is cut to a predetermined size so as to effectively create or define the packaging structure 122 as illustrated within FIG. 5.

More particularly, with reference now being made to FIG. 5, it is seen that the scored or embossed regions 168, 170 each have a substantially W-shaped cross-sectional configuration, although, as will be more fully appreciated hereinafter, other cross-sectional configurations are possible. In any case, the provision of the scored or embossed regions 168,170 having the W-shaped, cross-sectional configurations enables and facilitates the upward folding of the pair of oppositely disposed, laterally or transversely spaced side portions 174,176 of the packaging structure 122 with respect to a central portion 178 of the packaging structure 122 whereby once such pair of oppositely disposed, laterally or transversely spaced side portions 174,176 of the packaging structure 122 are in fact folded upwardly with respect to the central portion 178 of the packaging structure 122, the pair of oppositely disposed, laterally or transversely spaced side portions 174,176 of the packaging structure 122 effectively become the pair of oppositely disposed vertically upstanding side wall portions 114, 116 of the packaging container 110, while the central portion 178 of the packaging structure 122 effectively becomes the bottom wall member 112 of the packaging container 110, as disclosed within FIGS. 4 and 6.

It is to be appreciated that each one of the scored or embossed regions 168,170, having the substantially W-shaped cross-sectional configurations, effectively define longitudinally or axially extending, oppositely oriented inwardly and outwardly projecting pleated structures which, when the pair of oppositely disposed, laterally or transversely spaced side portions 174,176 of the packaging structure 122 are subsequently folded upwardly with respect to the central portion 178 of the packaging structure 122 so as to define or form the pair of oppositely disposed vertically upstanding side wall portions 114,116 of the packaging container 110, the longitudinally or axially extending, oppositely oriented inwardly and outwardly projecting pleated structures will effectively be expanded or enlarged so as to in fact permit the pair of oppositely disposed, laterally or transversely spaced side portions 174,176 of the packaging structure 122 to be easily folded upwardly with respect to the central portion 178 of the packaging structure 122 in order to define or form the pair of oppositely disposed vertically upstanding side wall portions 114,116 of the packaging container 110. It is additionally noted that not only is the upward folding of the pair of oppositely disposed vertically upstanding side wall portions 114,116 with respect to the central bottom wall portion 112 of the packaging container 110 facilitated, but in view of the fact that the corner regions 118,120 of the packaging container 110 are comprised of all, or certainly more than just the inner and outer two plies of the packaging container 110, then the flexural beam strength of the packaging container 110 within such corner regions 118,120 is substantially enhanced. With respect to the corner regions 118,120 of the packaging container 110, it is also noted that when the pair of oppositely disposed, laterally or transversely spaced side portions 174, 176 of the packaging structure 122 are in fact folded upwardly so as to effectively define the pair of oppositely disposed vertically upstanding side wall portions 114,116 with respect to the central bottom wall portion 112 of the packaging container 110, both of the pleated, scored, or embossed structures 168,170 will effectively be expanded and enlarged such that the corner regions 118,120 will exhibit rounded configurations which extend smoothly and continuously along both of the inner and outer surface portions of the packaging structure 110, and in the same arcuate manner, that is, they will be arcuately or angularly parallel to each other, as they extend from each one of the oppositely disposed side leg portions 114,116 to the central base portion 112.

Figure 5:
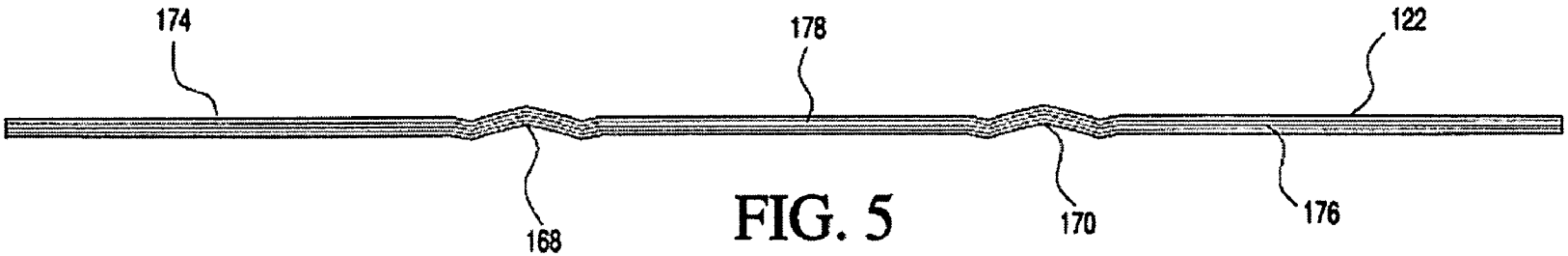
FIG. 5 is a side elevational view of a first embodiment of a packaging structure which has been fabricated in accordance with the principles and teachings of the present invention such that, in accordance with the specific principles and teachings of the present invention, first embodiments of scored or embossed regions are formed within the packaging structure at predetermined transversely spaced positions thereof.
Figure 6:
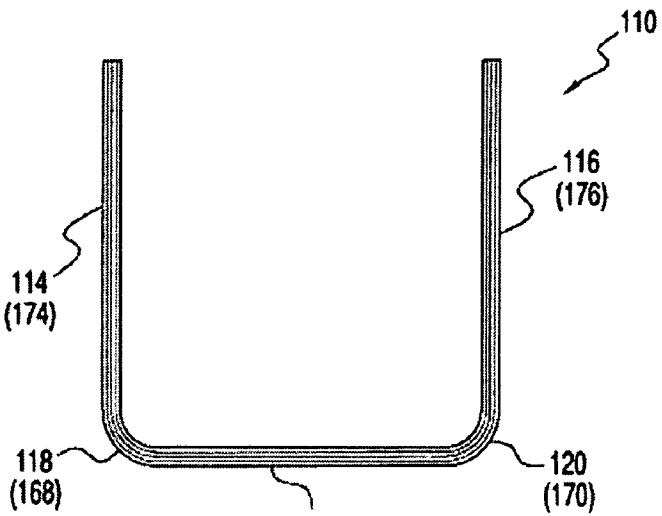
FIG. 6 is a side elevational view of the packaging structure, as illustrated within FIG. 5, wherein the oppositely disposed side portions of the first embodiment packaging structure have been folded upwardly at the scored or embossed locations so as to form a packaging container, which is similar to that illustrated within FIG. 4, so as to have a substantially U-shaped cross-sectional configuration.
Figure 8:
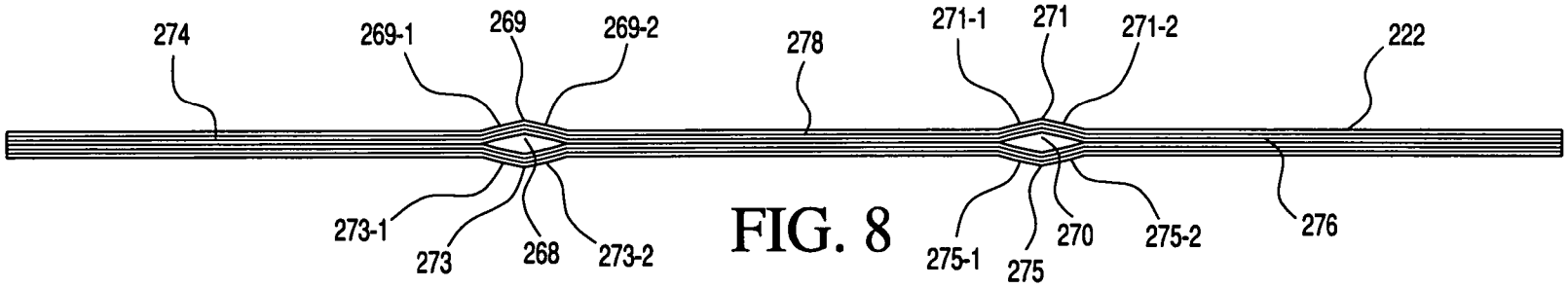
FIG. 8 is a side elevational view, similar to that of FIG. 5, illustrating, however, a second embodiment of a packaging structure which has been fabricated in accordance with the principles and teachings of the present invention such that, in accordance with the specific principles and teachings of the present invention, second embodiments of scored or embossed regions are formed within the packaging structure at predetermined transversely spaced positions.
Figure 9:
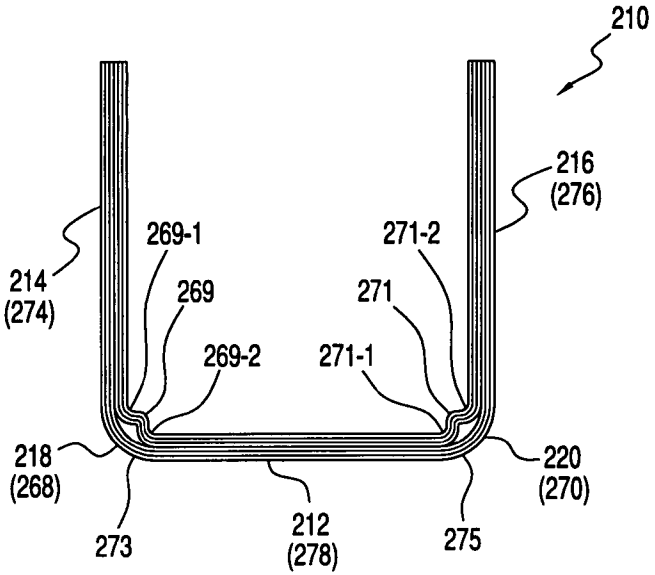
FIG. 9 is a side elevational view, similar to that of FIG. 6, illustrating, however, the packaging structure as illustrated within FIG. 8, wherein the oppositely disposed side portions of the first embodiment packaging structure have been folded upwardly at the scored or embossed locations so as to likewise form a packaging container, which is similar to that illustrated within FIG. 4, so as to have a substantially U-shaped cross-sectional configuration.

As has been previously noted, other types of scored or embossed regions, having differently shaped pleated structures, are possible in lieu of the scored or embossed regions having the substantially W-shaped cross-sectional configurations as illustrated within FIG. 5. In particular, the embossed or scored regions may have a substantially diamond-shaped cross-sectional configuration as illustrated at 268,270 within FIG. 8 wherein, for example, a pair of the innermost plies or sheets of the packaging structure 222 project upwardly or inwardly, as at 269,271, while a pair of the outermost plies or sheets of the packaging structure 222 project downwardly or outwardly as at 273,275. More particularly, it is seen that each one of the upwardly or inwardly projecting portions 269,271 comprises a pair of leg members 269-1,269-2, and 271-1,271-2, and each one of the downwardly or outwardly projecting portions 273,275 comprises a pair of leg members 2731,2732 and 2751,2752, the four leg members 2691,2692,2731, and 2732, and 2711,2712,2751,2752 of each of the embossed or scored regions 268,270 thereby defining the diamond-shaped embossed or scored regions 269,270. In this manner, when the pair of oppositely disposed, laterally or transversely spaced side portions 274,276 of the packaging structure 222 are subsequently folded upwardly with respect to the central portion 278 of the packaging structure 222 so as to define or form the pair of oppositely disposed vertically upstanding side wall portions 214,216 of the packaging container 210, as illustrated within FIG. 9, the longitudinally or axially extending, inwardly projecting pleated, scored, or embossed structures 269,271 will be folded inwardly still further, while the outwardly projecting pleated, scored, or embossed structures 273,275 will effectively be expanded or enlarged so as to in fact permit, enable, or facilitate the pair of oppositely disposed, laterally or transversely spaced side portions 274,276 of the packaging structure 222 to be easily folded upwardly with respect to the central portion 278 of the packaging structure 222 in order to define or form the pair of oppositely disposed vertically upstanding side wall portions 214,216 of the packaging container 210. It is particularly noted that when the pair of oppositely disposed, laterally or transversely spaced side portions 274,276 of the packaging structure 222 are folded upwardly with respect to the central portion 278 of the packaging structure 222 in order to define or form the pair of oppositely disposed vertically upstanding side wall portions 214,216 of the packaging container 210, the outwardly projecting pleated, scored, or embossed structures 273,275 will define the smoothly rounded corner regions 218,220 which extend arcuately or angularly between the distal end portions of the leg members 2691 and 2692, as well as between the distal end portions of the leg members 271-1, 2712 as is disclosed within FIG. 9.

Again, it is to be particularly noted that, as was the case with the packaging container 110, not only is the upward folding of the pair of oppositely disposed vertically upstanding side wall portions 214,216 with respect to the central bottom wall portion 212 of the packaging container 210 facilitated, but in view of the fact that the corner regions 218,220 of the packaging container 210 are comprised of all, or certainly more than just the inner and outer two plies of the packaging container 210, then the flexural beam strength of the packaging container 210 within such corner regions 218, 220 is substantially enhanced. It is lastly noted in connection with the packaging container 210, and particularly in connection with the scored or embossed regions 268, 270, that the upwardly or inwardly projecting portions are approximately one half the size of the downwardly or outwardly projecting portions, and that the pair of innermost plies or sheets of the packaging structure 222 having the upwardly extending projection portions, and the pair of outermost plies or sheets of the packaging structure 222 having the downwardly extending projections, are fabricated separately and are then subsequently combined.

Figure 7:
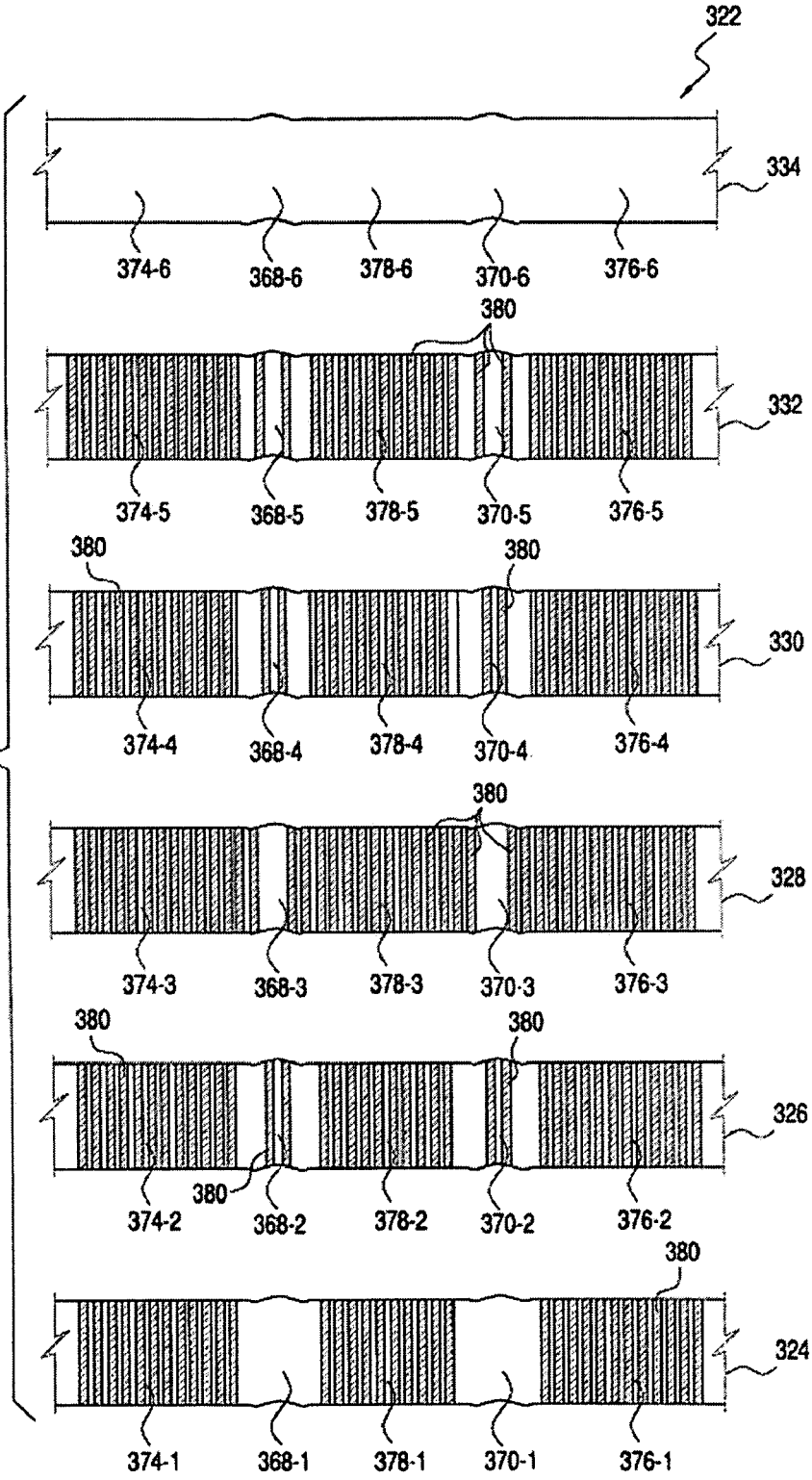
FIG. 7 is an exploded view illustrating the predetermined patterns of adhesive as applied to, or deposited upon, each one of the multiple plies comprising the packaging structure, except for the uppermost or innermost ply, so as to adhesively bond the multiple plies together in order to fabricate a packaging structure similar to that illustrated within FIG. 5.

With reference now being lastly made to FIG. 7, particular, predetermined patterns, arrangements, or arrays of the glue or adhesive, as deposited upon, or extruded onto, the various plies or sheets of a composite packaging structure 322, similar to, for example, the packaging structure 122 disclosed within FIG. 5, is disclosed. It is noted that unlike the packaging structure 122 as disclosed within FIG. 5, the packaging structure 322 is comprised of six plies or sheets 324,326,328, 330,332,334, wherein the ply or sheet 324 will comprise the lowermost bottom, or outer ply or sheet when the packaging structure 322 is formed into a packaging container, while the ply or sheet 334 will comprise the uppermost, top, or internal ply or sheet when the packaging structure 322 is formed into the packaging container. While the packaging structure 322 is illustrated as comprising the six sheets or plies 324,326,328, 330,332,334 of the suitable paper, cardboard, corrugated cardboard, thermoplastic material, or the like, a larger or smaller number of sheets or plies of such materials may of course be utilized. More particularly, in a manner similar to the packaging structure 122 as disclosed within FIG. 5, it is seen that the first sheet or ply 324 of the packaging structure 322 comprises a pair of oppositely disposed, laterally or transversely spaced side portions 374-1,376-1, a central portion 378-1, and a pair of scored or embossed regions 368-1, 370-1 respectively interposed between the left side portion 374-1 and the central portion 378-1, and between the central portion 378-1 and the right side portion 376-1, wherein each one of the pair of scored or embossed regions 368-1,370-1 has a substantially W-shaped cross-sectional configuration similar to that of the scored or embossed regions 168,170 disclosed in connection with the packaging structure 122 as disclosed within FIG. 5. In a similar manner, the second sheet or ply 326 of the packaging structure 322 comprises a pair of oppositely disposed, laterally or transversely spaced side portions 374-2, 376-2, a central portion 378-2, and a pair of scored or embossed regions 368-2,370-2 respectively interposed between the left side portion 374-2 and the central portion 378-2, and between the central portion 378-2 and the right side portion 376-2, wherein, likewise, each one of the pair of scored or embossed regions 368-2,370-2 also has a substantially W-shaped cross-sectional configuration, and continuing further, the third sheet or ply 328 of the packaging structure 322 comprises a pair of oppositely disposed, laterally or transversely spaced side portions 374-3,376-3, a central portion 378-3, and a pair of scored or embossed regions 368-3,370-3 respectively interposed between the left side portion 374-2 and the central portion 378-3, and between the central portion 378-3 and the right side portion 376-3, wherein, likewise, each one of the pair of scored or embossed regions 368-3,370-3 also has a substantially W-shaped cross-sectional configuration.

Still further, the fourth sheet or ply 330 of the packaging structure 322 comprises a pair of oppositely disposed, laterally or transversely spaced side portions 374-4, 376-4, a central portion 378-4, and a pair of scored or embossed regions 368-4,370-4 respectively interposed between the left side portion 374-4 and the central portion 378-4, and between the central portion 378-1 and the right side portion 376-4, wherein each one of the pair of scored or embossed regions 368-4,370-4 correspondingly has a substantially W-shaped cross-sectional configuration similar to those of the scored or embossed regions 368-1,368-2,368-3,370-1,370-2, 370-3 of the sheets or plies 324,326,328. In a similar manner, the fifth sheet or ply 332 comprises a pair of oppositely disposed, laterally or transversely spaced side portions 374-5,376-5, a central portion 378-5, and a pair of scored or embossed regions 368-5,370-5 respectively interposed between the left side portion 374-5 and the central portion 378-5, and between the central portion 378-5 and the right side portion 376-5, wherein, likewise, each one of the pair of scored or embossed regions 368-5,370-5 also has a substantially W-shaped cross-sectional configuration, and lastly, the sixth sheet or ply 334 comprises a pair of oppositely disposed, laterally or transversely spaced side portions 374-6,376-6, a central portion 378-6, and a pair of scored or embossed regions 368-6,370-6 respectively interposed between the left side portion 374-6 and the central portion 378-6, and between the central portion 378-6 and the right side portion 376-6, wherein, likewise, each one of the pair of scored or embossed regions 368-6, 370-6 also has a substantially W-shaped cross-sectional configuration.

Figure 10:
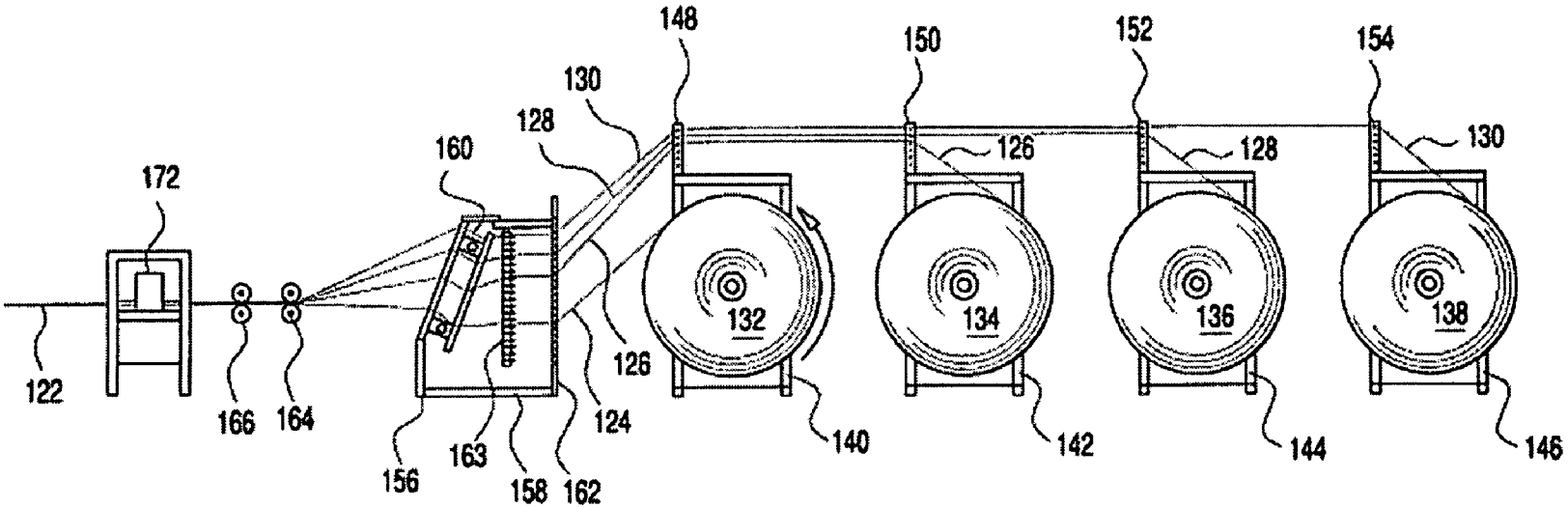
FIG. 10 is a schematic drawing illustrating the apparatus for fabricating the new and improved packaging container of the present invention.

Continuing still further, in accordance with another unique and novel feature characteristic of the packaging structure and the packaging container constructed in accordance with the principles and teachings of the present invention, it is seen that each one of the first, second, third, fourth, and fifth sheet or ply of material 324,326,328,330, and 332 has a particular or predetermined pattern of glue or adhesive deposited or extruded thereon in axially extending, laterally spaced stripes which correspond to the direction in which the plies or sheets 324-334 are conveyed through, for example, the glue application tree 160 as illustrated within FIG. 10. More particularly, it is seen that each one of the inner surface portions of the left, right, and central portions 374-1 through 374-6, 376-1 through 376-6, and 378-1 through 378-6 of the plies or sheets 324-332 of the packaging structure 322 is provided with a suitable glue or adhesive material 380, however, the scored or embossed regions 368-1, 370-1 of the lowermost or outer ply or sheet 324 are devoid of glue or adhesive. To the contrary, the embossed or scored regions 368-2,370-2 of the second outermost ply or sheet 326 have the glue or adhesive 380 applied to the centralmost regions thereof, whereas the embossed or scored regions 368-3, 370-3 of the third ply or sheet 328 have the glue or adhesive 380 applied to the laterally outer regions thereof while the centralmost regions thereof are devoid of the glue or adhesive 380.

Continuing further, the embossed or scored regions 368-4, 370-4 of the fourth ply or sheet 330 have glue or adhesive 380 applied to the centralmost regions in a manner similar to that characteristic of the second outer ply or sheet 326, whereas the embossed or scored regions 368-5,370-5 of the fifth or second innermost ply or sheet 332 has glue or adhesive 380 applied to portions thereof which are immediately adjacent to the centralmost regions thereof. In this manner, it can be appreciated that the various glue or adhesive patterns disposed upon or extruded onto the various embossed or scored regions 368-2 through 368-5,370-2 through 370-5 of the plies or sheets 326 through 332 are effectively staggered with respect to each other in the lateral or transverse direction. This is important because while providing the glue or adhesive 380 within the embossed or scored regions 368-2 through 368-5, 370-2 through 370-5 of the plies or sheets 326 through 332 of the packaging structure 3220 enhances the flexural beam strength properties of the corner regions of the packaging container to be formed from the packaging structure 322, too much glue or adhesive, disposed within such embossed or scored regions 368-2 through 368-5,370-2 through 370-5 of the plies or sheets 326 through 332 of the packaging structure 322, particularly in an aligned or nonstaggered array, will adversely affect the ease of upwardly folding the side portions 374-1 through 374-6,376-1 through 376-6 of the plies or sheets 324-334 with respect to the central portions 378-1 through 378-6 of the plies or sheets 324-334 when the packaging structure 322 is formed into the packaging container. It is of course to be understood that while particular, staggered or non-aligned glue or adhesive patterns have been illustrated, other similar glue or adhesive patterns are of course possible.

Thus, it may be seen that in accordance with the teachings and principles of the present invention, there has been disclosed a new and improved packaging container, and a method and apparatus for fabricating the same, which comprises a laminated structure comprising a plurality of sheets or plies formed from suitable paper, cardboard, corrugated cardboard, thermoplastic materials, or the like, wherein the plurality of sheets or plies, having a predetermined width dimension, are bonded together in a substantially flattened state by means of a suitable adhesive or glue which is applied in predetermined, longitudinally or axially extending laterally staggered patterns. Subsequently, the substantially flat, laminated structure is longitudinally or axially scored or embossed at predetermined lateral or transverse positions so as to effectively predispose, and thereby facilitate or simplify, for example, the upward folding of oppositely disposed side wall members of the laminated structure with respect to a central bottom wall member of the laminated structure whereby the resulting packaging container not only has a desirable substantially U-shaped cross-sectional configuration, but in addition, has optimized flexural beam strength characteristics within the corner regions thereof due to the fact that the oppositely disposed corner regions preferably comprise the same number of multiple plies as the side wall and bottom wall members of the packaging container.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A packaging container, comprising:

a plurality of plies of material disposed atop one another in a stacked array so as to form a packaging structure having an inner surface portion and an outer surface portion, wherein all of said plies of material have substantially the same lateral width dimension as defined between a pair of oppositely disposed side edge portions thereof; and embossed means formed within said packaging structure at locations defined predetermined distances inwardly from said pair of oppositely disposed side edge portions of said packaging structure, and comprising pleated means having a substantially W-shaped cross-sectional configuration, for facilitating the folding of oppositely disposed side portions of said packaging structure, which are defined between said embossed means and said pair of oppositely disposed side edge portions of said packaging structure so as to define oppositely disposed side leg portions, with respect to a central base portion of said packaging structure at corner regions of a resulting packaging container defined by said oppositely disposed side leg portions and said central base portion, wherein said pleated structures will effectively be expanded and enlarged so as to permit said oppositely disposed side leg portions of said packaging structure to be easily folded upwardly wherein said corner regions will exhibit rounded configurations which extend smoothly and continuously along both said inner and outer surface portions of said packaging structure, with substantially the same radial curvature, from each one of said oppositely disposed side leg portions to said central base portion, and wherein said corner regions will exhibit good flexural beam strength resistance properties in view of the fact that said corner regions of said packaging container comprise all of said plies of material comprising said packaging structure.

2. The packaging container as set forth in claim 1, wherein: said packaging container has a substantially U-shaped cross-sectional configuration comprising said oppositely disposed side portions and said central portion.

3. The packaging container as set forth in claim 1, wherein: said plurality of plies of material are adhesively bonded together so as to form a laminated structure.

4. The packaging container as set forth in claim 3, wherein: adhesive bonding material is disposed within said corner regions of at least one of said plurality of plies of material comprising said packaging container so as to positively affect said flexural beam strength resistance properties of said corner regions of said packaging container.

5. The packaging container as set forth in claim 4, wherein: said adhesive bonding material is disposed within said corner regions of more than one of said plurality of plies of material comprising said packaging container.

6. The packaging container as set forth in claim 5, wherein: said adhesive bonding material is deposited within said corner regions of said more than one of said plurality of plies of material in accordance with predetermined patterns.

7. The packaging container as set forth in claim 6, wherein: said predetermined patterns comprising said deposition of said adhesive bonding material within said corner regions of said more than one of said plurality of plies of material are different and staggered between any two plies of material disposed in contact with each other so as not to adversely affect the folding capabilities of said plurality of plies of material within said corner regions of said packaging container.

8. The packaging container as set forth in claim 1, wherein: said plies of material are selected from the group comprising paper, cardboard, corrugated cardboard, and plastic.

9. A packaging container, comprising:

a plurality of plies of material disposed atop one another in a stacked array so as to form a packaging structure having an inner surface portion and an outer surface portion, wherein all of said plies of material have substantially the same lateral width dimension as defined between a pair of oppositely disposed side edge portions thereof; and embossed means, formed within said packaging structure at locations defined predetermined distances inwardly from said pair of said oppositely disposed side edge portions of said packaging structure, and comprising pleated structures having a substantially diamond-shaped cross-sectional configurations comprising a plurality of inwardly disposed plies of material defining a first pair of leg members and a plurality of outwardly disposed plies of material defining a second pair of leg members, for facilitating the upward folding of oppositely disposed side portions of said packaging structure, which are defined between said embossed means and said pair of oppositely disposed side edge portions of said packaging structure, and which define oppositely disposed side leg portions of said packaging structure, with respect to a central base portion of said packaging structure, at corner regions of a resulting packaging container defined by said oppositely disposed side leg portions and said central base portion of said packaging structure, wherein said plurality of outwardly disposed plies of material of said pleated structures defining said second pair of leg members of said diamond-shaped cross-sectional configuration will effectively be expanded as said oppositely disposed side leg portions of said packaging structure are folded upwardly so as to permit said oppositely disposed side leg portions of said packaging structure to be easily folded upwardly wherein external corner regions of said packaging container will exhibit rounded configurations which extend smoothly and continuously along said outer surface portions of said packaging container constantly curving from locations at which each one of said first pair of leg members, of said substantially diamond-shaped cross-sectional configurations of said pleated structures, meet said oppositely disposed side leg portions of said packaging structure, to said central base portion, wherein said plurality of inwardly disposed plies of material of said pleated structures defining said first pair of leg members of said diamond-shaped cross-sectional configurations will effectively be compressed so as to project inwardly within said pack-aging structure with a substantially inverted V-shaped configuration and thereby permit said oppositely disposed side leg portions of said pack-aging structure to be easily folded upwardly and thereby form inner corner regions of said packaging container, and wherein said corner regions of said packaging container will exhibit good flexural beam strength resistance properties in view of the fact that said corner regions of said packaging container comprise all of said plurality of plies of material comprising said packaging structure.

10. The packaging container as set forth in claim 9, wherein:

said packaging container has a substantially U-shaped cross-sectional configuration comprising said oppositely disposed side portions and said central portion.

11. The packaging container as set forth in claim 9, wherein:

said plurality of plies of material are adhesively bonded together so as to form a laminated structure.

12. The packaging container as set forth in claim 11, wherein:

adhesive bonding material is disposed within said corner regions of at least one of said plurality of plies of material comprising said packaging container so as to positively affect said flexural beam strength resistance properties of said corner regions of said packaging container.

13. The packaging container as set forth in claim 12, wherein:

said adhesive bonding material is disposed within said corner regions of more than one of said plurality of plies of material comprising said packaging container.

14. The packaging container as set forth in claim 13, wherein:

said adhesive bonding material is deposited within said corner regions of said more than one of said plurality of plies of material in accordance with predetermined patterns.

15. The packaging container as set forth in claim 14, wherein:

said predetermined patterns comprising said deposition of said adhesive bonding material within said corner regions of said more than one of said plurality of plies of material are different and staggered between any two plies of material disposed in contact with each other so as not to adversely affect the folding capabilities of said plurality of plies of material within said corner regions of said packaging container.

16. The packaging container as set forth in claim 9, wherein:

said plies of material are selected from the group comprising paper, cardboard, corrugated cardboard, and plastic.

* * * * *

UNITED STATES PATENT AND TRADEMARK OFFICE

CERTIFICATE OF CORRECTION

PATENT NO. : 7,661,579 B2
APPLICATION NO. : 11/228408
DATED : February 16, 2010
INVENTOR(S) : Kruelle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 709 days.

Signed and Sealed this

Thirtieth Day of November, 2010

David J. Kappos

David J. Kappos
*Director of the United States Patent and Trademark Office*